United States Patent [19]

Schneider

[11] Patent Number: 4,750,994

[45] Date of Patent: Jun. 14, 1988

[54] FLOTATION APPARATUS

[75] Inventor: John C. Schneider, Acton, Canada

[73] Assignee: Hydrochem Developments Ltd., Brampton, Canada

[21] Appl. No.: 96,538

[22] Filed: Sep. 15, 1987

[51] Int. Cl.[4] ..... B03D 1/16; B03D 1/26

[52] U.S. Cl. ..... 209/170; 209/169; 210/219; 210/221.2; 261/93; 366/103; 366/104; 366/295

[58] Field of Search ..... 209/168, 169, 170; 261/93; 366/103, 104, 102, 295, 294, 293; 210/219, 221.2

[56] References Cited

U.S. PATENT DOCUMENTS

| | | | |
|---|---|---|---|
| 627,895 | 6/1899 | Bishof | 366/104 |
| 1,737,410 | 11/1929 | Corcoran . | |
| 1,932,531 | 10/1933 | Parker . | |
| 2,312,563 | 3/1943 | Lewers . | |
| 2,554,480 | 5/1951 | Morton . | |
| 2,610,737 | 9/1952 | Eder . | |
| 2,693,129 | 5/1953 | Rossett | 261/93 |
| 2,804,379 | 6/1956 | Wistrich | 261/93 |
| 2,928,661 | 6/1958 | MacLaren | 261/93 |
| 3,298,519 | 1/1967 | Hollingsworth | 209/170 |
| 3,801,370 | 4/1974 | Porter et al. . | |
| 3,865,721 | 2/1975 | Kaelin | 261/93 |
| 4,163,723 | 8/1979 | Romano et al. . | |
| 4,454,077 | 6/1984 | Litz | 366/295 |

*Primary Examiner*—Kenneth M. Schor
*Assistant Examiner*—Thomas M. Lithgow

[57] ABSTRACT

A device for suspending solid particles in a turbulent fluid for the purpose of concentrating particles of interest such as mineral particles comprises an upright column provided with a plurality of impellers spaced along a rotatable shaft extending centrally within the column. An inlet is provided near the bottom of the column to introduce compressed gas which is dispersed by the rotating impellers to create a rising column of bubbles through a slurry of particles in a liquid so that a gas to liquid gradient is provided along the column. Disks are spaced along the shaft between the impellers, and baffles are provided longitudinally at the inner surface of the column to control the swirling of the fluid caused by the impellers.

15 Claims, 1 Drawing Sheet

FLOTATION APPARATUS

The present invention relates to a device in which solid particles may be suspended in a fluid medium and separated therein according to flotation characteristics. The invention may be generally designated a flotation apparatus, but it should be understood that the invention may be used in a number of applications in addition to flotation.

The extraction of metal from an ore frequently involves the initial steps of crushing the ore and subjecting the resultant particles to a froth flotation separation wherein the mineral bearing particles are separated from the gangue. The separation of particles using a flotation process involves satisfying two fundamental requirements. Bubbles and particles must come into contact with one another, and the particles which are floated must attach to the bubbles or have an affinity for attaching to the bubbles. Conventional flotation devices employ agitation of an aqueous medium with an impeller, and air may be added along with suitable chemicals to create a froth comprising bubbles to which the mineral containing particles adhere.

The present invention is concerned with an apparatus for generating a column of upwardly vectored bubbles moving through a downwardly flowing slurry of a crushed ore and aqueous liquid and does not primarily rely on the chemical reagents employed for the purpose of causing or enhancing particle adherence to the bubbles. The invention is directed to that type of apparatus wherein pressurized gas, usually air, is introduced at or near the bottom of the device and impellers are employed to generate a column of rising bubbles and turbulent fluids having the desired characteristics for a particular flotation application.

A problem frequently encountered with prior devices is the continuous recycling of mineral particles from the froth to the liquid portion of the fluid due to convection currents induced by the agitation of the liquid in the device. The present apparatus largely eliminates these convection currents in the liquid thereby creating a stable froth while minimizing froth entrainment into the ore slurry or pulp. The present apparatus allows the user to approach the ideal or "plug" flow for mineral particles of interest through the several stages of the apparatus, thereby enabling an optimization of the concentration process in a compact, versatile apparatus.

The present apparatus also employs a plurality of efficiently designed impellers so that desired agitation can be achieved at minimal horsepower requirements.

Accordingly, the invention provides a device for suspending solid particles in a turbulent fluid for the purpose of concentrating particles of interest such as mineral particles. The device comprises an upright column defining up to five functional zones along the height thereof. In a froth flotation application for concentrating a mineral from a crushed ore slurry, the device may comprise a column having from bottom to top a suspension zone to slurry gangue particles leaving the column, a gas dispersion zone, a zone for collecting the mineral particles on upwardly moving bubbles, a zone for washing residual gangue from the floating mineral particles, and an upper zone where the mineral is concentrated on a froth of bubbles and removed from the column. The column is provided with an outlet at the bottom for removing a slurry of gangue, an inlet near the bottom for introducing compressed gas, an inlet above the gas inlet for introducing a slurry of crushed ore in a liquid into the column, optionally an inlet near the top of the column for introducing a wash liquid, and an outlet such as a launder at the top of the column for removing a froth containing mineral particles.

Agitation of the fluid and dispersion of the compressed gas within the column is provided by a plurality of impellers attached along a rotatable shaft extending centrally within the column. The impellers are spaced along the shaft in at least the lower and middle zones of the column and have numbers of blades and pitch angles therefor to provide turbulence to the fluid within the column and to achieve the desired gas dispersion gradient along the height of the column. The turbulence from the impellers causes the gas bubbles formed initially at the bottom of the column to be dispersed throughout the slurry as they rise up the column.

While the impellers may be designed to create the desired gas dispersion gradient and fluid turbulence along the height of the column, the superior flotation characteristics of the present invention are provided by controlling the horizontal and vertical swirling caused by the impellers so that a dynamic column of upwardly vectored bubbles is generated enabling the steady upward movement of the particles of interest and minimizing the recycling of such particles between the froth and liquid portions. This control is provided by disks attached to the shaft between adjacent impellers and by longitudinal baffles positioned about the inner circumference of the column.

The impeller system for the apparatus effectively causes the function of the collecting zone to be divided into a number of stages, each impeller providing a stage. In the collecting zone the mass transfer rate of solids to bubbles is increased, and the short circuiting of feed is decreased as compared to known flotation devices. Thus, collection is improved and tail losses are minimized. In certain applications, it may be desirable to provide impellers in the washing zone to increase the washing performance for removal of residual gangue, thereby improving the grade and quality of the concentrate. Overall, the impeller system of the invention provides controlled gas dispersion and flexibility for designing the optimum performance in each particular application.

One objective of the present invention is maximization of product loading on air bubbles, on the premise that this loading will minimize loading of gangue on the bubbles. As is implied by earlier work in single stage flotation the enrichment ratio appears related to particle size, and is fixed. However, when such gangue loaded air bubbles are then contacted with a richer mineral slurry in a subsequent stage under selective conditions of turbulence, bubble coalescence and redispersion, and solids detachment and attachment occur. It is a premise of this work that these processes favour product flotation over gangue flotation. Accordingly, the present apparatus provides multiple staging with countercurrent flow of air and slurry. From bottom to top the slurry in each stage of the apparatus becomes richer in product, which also favours its flotation.

Another feature of the invention involves the ability to vary the agitation level from bottom to top of the apparatus. The ability to provide an agitation gradient has several effects. It ensures larger bubbles at the top, and smaller ones toward the bottom of the apparatus. The smaller bubbles, in the 0.5–1.5 mm diameter range are large enough to ascend in the slurry downflow. Introducing the feed slurry near the top of the apparatus ensures that the larger product particles will encounter bubbles large enough to carry them speedily into the froth, whereas lower down in the apparatus, the finer air bubbles and higher agitation level increase the probability of particle-bubble collisions for fines. In this manner the compromises hampering efficiency in conventional mechanical cell design have been advantageously overcome, including the near impossibility of sanding up the bottom of the apparatus and the potential reduction in frother consumption due to the lower air volume used when compared to a bank of flotation cells.

These and other advantages of the invention will be described in more detail with reference to the drawings of a preferred embodiment thereof, wherein.

The preferred embodiment shown in the figures will be described with reference to a mineral froth flotation process. The reader skilled in this art will appreciate that the invention may be used for other purposes and may incorporate modifications to the structure hereinafter described for the purpose of addressing such other applications.

Figure 1:
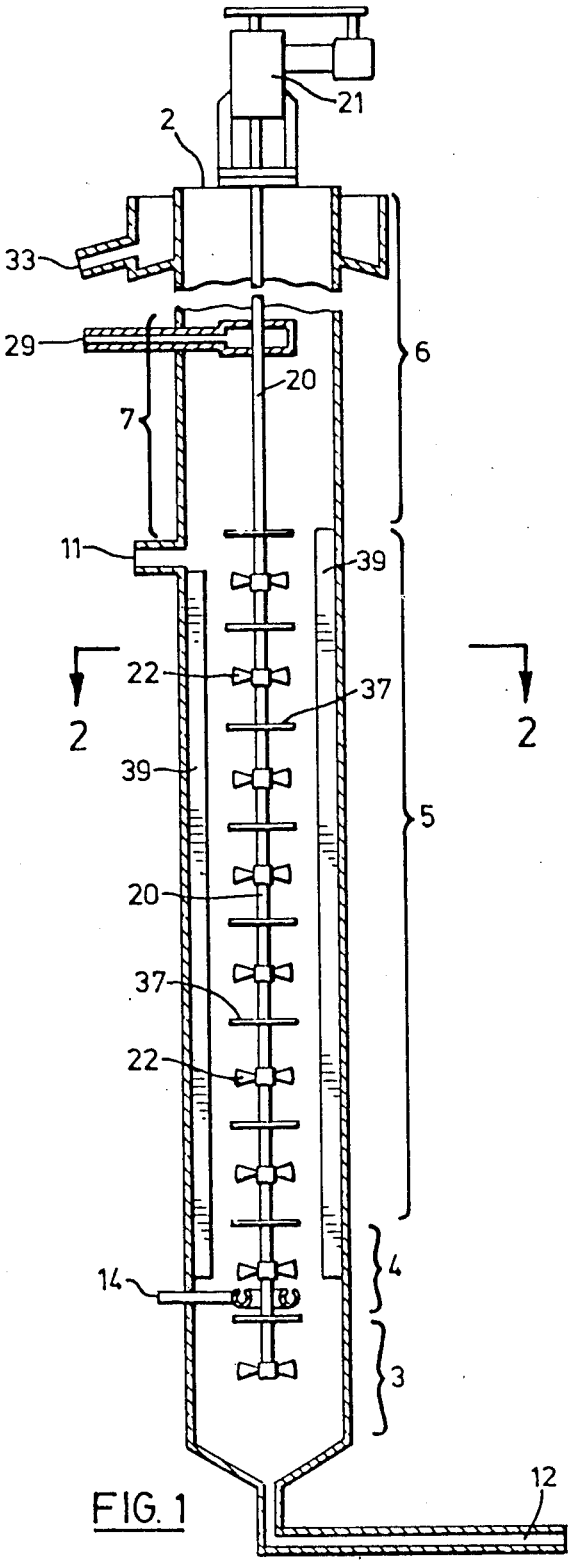
FIG. 1 is a longitudinal sectional view of a column of the invention.

As seen in FIG. 1, the invention comprises a cylindrical column 2 which may have five functional zones 3, 4, 5, 6 and 7. In a mineral froth flotation process, crushed ore containing mineral particles of interest is slurried in water to which suitable flotation aiding chemicals are added. The slurry is introduced into the column 2 through an inlet 11 preferably located near the junction of zones 5 and 6. In the collection zone 5, a rising column of bubbles interacts with the mineral particles in the pulp and the desired mineral particles are collected by the bubbles and floated upwardly through the froth and washing zones 6 and 7. The rising column of bubbles is generated initially in the gas dispersion zone 4 at the bottom of the column 2. An inlet 14 is provided for introducing a compressed gas such as air into the column 2, and the inlet 14 is preferably positioned to introduce air axially of the column 2. It may be preferable in some applications to sparge the air into the column 2 through the inlet 14.

The column 2 is provided with a shaft 20 extending centrally within the column 2 from the top to near the bottom thereof. Means are provided for rotating the shaft 20 such as a motor 21. The shaft 20 is equipped with a plurality of impellers 22 attached at spaced intervals along its length. The gas dispersion zone 4 also includes an impeller 22 located just above the gas inlet 14 to provide an initial gas dispersion of the air entering the column 2 into the pulp flowing down the column 2.

The column 2 has an outlet 12 at the bottom thereof for removing a slurry of solid particles which are depleted of the mineral of interest. These particles comprise valueless solids, or gangue, and perhaps mineral particles which are not of interest or which may be recovered at a subsequent process stage. In the suspension zone 3 impeller 22 is affixed to the bottom of the shaft 20 to maintain the gangue as a slurry so that it may be readily removed via the outlet 12.

Upon rotation of the shaft 20, the impellers 22 generate turbulence in the fluid within the column 2. This turbulence serves to disperse the gas entering through the inlet 14, but provides a neutral flow direction to the fluid within the column 2. To provide a gradient of turbulence along the height of the column 2, the impellers 22 must be individually constructed to provide greater or lesser turbulence at a given constant speed of rotation. This may be done by varying the diameter of the impeller 22, the number of blades and the pitch angles thereof associated with each impeller 22. In a mineral flotation process, impellers 22 having a longer diameter, or a greater number of blades or with sharper pitch angles to generate a greater turbulence are located toward the bottom of the column 2. Of course, the rotation speed of the shaft 20 can also be varied to provide greater or lesser turbulence. The ability to adjust the rotation speed as well as the structures of the various impellers 22 provides the device with a wide range of operating conditions.

For example, the collection zone 5 may comprise seven impellers 22 spaced along the shaft 20 for generating a turbulence gradient within the zone 5 causing an upwardly directed increase in the gas to liquid ratio. The number and structures of impellers 22 used within the zone 5 may vary in accordance with the particular requirements of a given application. That is because each impeller 22 acts to provide a stage of the overall process being carried out in the zone 5. Thus, the more impellers 22 used the greater the efficiency of recovery or collection of the mineral particles of interest. Of course, there is a point reached where the expense of enlarging the zone 5 by adding additional impellers 22 is greater than the increased benefit derived. It will be appreciated by those skilled in this art that the structure of the column 2, especially as it relates to the collection zone 5, has a high degree of inherent flexibility allowing the structure to be modified to create the flotation conditions most suited to a given ore.

In the froth zone 6 of the column 2, collected mineral particles may move upwardly on a froth of bubbles through a wash zone 7 where small particles of gangue are removed.

This is accomplished in the present invention by introducing a wash liquid such as water through an inlet 29 at the upper portion of the column 2. The wash water is preferably sparged into the column 2 as a spray of fine droplets, and the exact location of the inlet 25 in relation to the froth zone 6 may vary considerably with the particular application.

The shaft 20 extending through the froth zone 6 is not usually provided with impellers 22 as shown in FIG. 1, but it may be desirable to do so in the wash zone 7 especially in cases where high quality concentrates are desired.

The material exiting the top of the column 2, preferably through a launder 33, is a froth of bubbles to which are adhered an extremely clean concentrate of mineral particles of interest. The froth zone 6 may not be very large since the froth must be removed from the column 2 before it breaks down. Again, the relative sizes of the froth and washing zones 6 and 7 will depend on the particular application including such factors as particle size and bubble size.

An important feature of the invention is the use of disks and baffles to control both the horizontal and the vertical swirl effects imparted to the fluid in the column 2 by the impellers 22, and to help define discrete zones or stages of turbulence along the height of the fluidized column. Without the disks 37, the impellers 22 spaced along the shaft 20 would give a fully back mixed system having little concentration gradient from the bottom to the top of the column 2. Thus, disks 37 are affixed to the shaft 20 between adjacent impellers 22 to isolate the vertical motion of the fluid in the column 2 and to form toroids around each impeller 22. These disks 37 are solid and flat, generally having a diameter greater than that of the diameter of the impellers 22, but clearly, may be adapted to meet the particular needs of a given application. The disks 37 need not all be of the same diameter.

Figure 2:
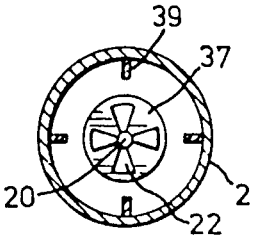
FIG. 2 is a sectional view along line 2—2 in FIG. 1.

In conjunction with the disks 37, longitudinal baffles 39 are preferably positioned in the gas dispersion and collection zones 4 and 5 about the inner circumference of the column 2. The baffles 39 sustain the toroids and increase turbulence. The number and width of these longitudinal baffles 39 also depend on the particular application, but often four such baffles 39 positioned 90° from one another and each having a width of about one-twelfth the diameter of the column 2 provide the desired degree of control (see FIG. 2).

The disks 37 and baffles 39 can be adjusted to control the degree of back mixing by operating to modulate the swirling effects imparted by the impellers 22, thereby promoting a staged upward bubble flow pattern within the column 2. The disks 37 and baffles 39 help define discrete zones or stages of turbulence about each impeller 22 thereby promoting so called plug flow. It has been shown that the present combination of impellers 22 and disks 37 allows the creation of a fluid volume within the column 2 which is approximately 50% greater than that of the nonagitated liquid.

Every column application need not incorporate all five zones. For regular grind flotation feed, the suspension and gas dispersion zones can be combined. Where the proportion of slimes is low, froth washing becomes optional.

The invention enables the creation of mineral bearing froth which is relatively stable due to lack of swirling currents beneath it, and wherein the mineral particles floated form a high grade concentrate. These advantages may be further illustrated by the following examples.

Performance of a Pilot Column on Mill Rougher Concentrate

Lower than normal grade rougher concentrates of an arsenopyrite ore were produced off flotation cells during metallurgical evaluation testwork performed at Red Lake, Ontario. These concentrates were used for upgrading in a 200 mm (8") diameter pilot column made in accordance with the invention. Batch flotation tests in a small 150×150×255 mm (6"×6"×12") flotation cell were run in parallel for comparison. Results are given in Tables 1 and 2. The 7.5 minute batch float (Table 2) matched mill performance only when chemicals were added. Without chemicals, the tails were higher after 7.5 minutes. This is probably due to slower floating arsenopyrite, which carries the gold. The arsenic content peaked at 1 minute in the batch test. The same phenomenon was noted in the plant, where the As/S ratio in the concentrate from the second cell was higher than that of the first one.

To determine the performance of the pilot column on the rougher concentrate, four consecutive tests were run at constant agitation (508 rpm) and air flow (577 l/min). Reagent addition began in Test 3 with $Na_2S$. Xanthate and $CuSO_4$ were added in Test 4, and Dowfroth (trade mark) addition commenced in Test 5. Amount of reagent addition to system was as follows:

| | | |
|---|---|---|
| $Na_2S$ | 22.5 g/tonne | 10% solution |
| Na isobutyl xanthate | 41.5 g/tonne | 9% solution |
| $CuSO_4$ | 96.6 g/tonne | 7% solution |
| Dowfroth | 2.7 g/tonne | 15% solution |

The basis for the amount of reagent added was the assumption that the mill rougher concentrate sample had depleted its reagent when dewatered for use in this testing. Rather arbitrarily, 50% of the normal mill reagent addition was added to column and batch flotation feed, except for Dowfroth which in the testing was added at 10% of the plant concentration.

Column tests 2 and 4 are directly comparable to the batch flotation tests. The upgrading capability of the agitated column is highly promising. Concentrate to tails partition ratios for gold range from 32 to 47, with similar values for arsenic. Sulphur partition ratios are lower, for reasons that are not fully understood. Column tailings are cleaner, while grades are higher than in batch flotation, even for the first concentrate collected.

TABLE 1

LABORATORY COLUMN FLOTATION OF MILL ROUGHER CONCENTRATE

| CONSECUTIVE TEST AND REAGENT | | RATE g/min | GRADE Au g/tonne | GRADE As % | GRADE S % | RECOVERY Au % | RECOVERY As % | RECOVERY S % |
|---|---|---|---|---|---|---|---|---|
| 2. | Conc. | 20.7 | 55.9 | 19.80 | 14.80 | 85.9 | 77.9 | 67.6 |
| None | Tails | 124.2 | 1.7 | 0.85 | 1.45 | 16.1 | 20.1 | 39.7 |
| | Feed | 144.9 | 9.3 | 3.63 | 3.13 | 102.0 | 98.0 | 107.3 |
| 3. | Conc. | 27.4 | 52.1 | 19.50 | 13.10 | 86.4 | 82.6 | 64.1 |
| $Na_2S$ | Tails | 153.2 | 1.4 | 0.69 | 1.43 | 13.4 | 16.4 | 39.1 |
| | Feed | 180.6 | 9.2 | 3.58 | 3.10 | 99.8 | 99.0 | 103.2 |
| 4. | Conc. | 18.3 | 58.6 | 21.50 | 13.60 | 88.7 | 83.0 | 60.7 |
| Xanthate | Tails | 114.8 | 1.4 | 0.70 | 1.24 | 13.0 | 17.0 | 34.7 |
| $CuSO_4$ | Feed | 133.1 | 9.1 | 3.56 | 3.08 | 101.7 | 100.0 | 95.4 |
| 5. | Conc. | 58.2 | 35.3 | 13.30 | 10.10 | 91.4 | 88.1 | 77.0 |
| Dowfroth | Tails | 192.0 | 0.9 | 0.35 | 1.13 | 7.9 | 7.7 | 28.4 |
| | Feed | 250.2 | 9.0 | 3.51 | 3.05 | 99.3 | 95.8 | 104.5 |

TABLE 2

LABORATORY BATCH FLOTATION OF MILL ROUGHER CONCENTRATE

| | No reagents | | | | 50% of mill reagents | | | |
|---|---|---|---|---|---|---|---|---|
| Minutes (incremental) | Wt. % of feed | Au g/tonne | As % | S % | Wt. % of feed | Au % | As % | S % |
| 0.25 | 6.2 | 39.1 | 14.4 | 17.8 | 8.0 | 51.1 | 17.7 | 16.1 |
| 0.25 | 2.8 | 43.2 | 15.6 | 17.4 | 4.8 | 45.9 | 17.2 | 14.6 |
| 0.50 | 2.7 | 48.7 | 17.2 | 14.9 | 4.5 | 42.9 | 16.5 | 11.9 |
| 0.50 | 2.1 | 39.9 | 15.4 | 11.7 | 3.2 | 29.5 | 11.4 | 9.0 |
| 1.00 | 2.6 | 36.4 | 13.5 | 9.5 | 5.4 | 14.7 | 6.1 | 4.8 |
| 1.00 | 1.7 | 27.8 | 11.5 | 7.7 | 2.7 | 10.3 | 4.6 | 3.9 |
| 2.00 | 2.7 | 23.3 | 9.0 | 6.2 | 1.9 | 11.3 | 5.2 | 4.5 |
| 2.00 | 1.7 | 17.5 | 7.8 | 5.3 | 1.5 | 9.6 | 4.6 | 4.0 |
| Tails | 77.6 | 3.8 | 1.5 | 1.7 | 67.9 | 1.5 | 0.6 | 1.0 |
| Total Conc. (Calc.) | | 36.1 | 14.0 | 12.2 | | 33.0 | 13.8 | 11.9 |

I claim:

1. A device for suspending solid particles in a turbulent fluid for the purpose of concentrating particles of interest, comprising:

an upright hollow column having an outlet means at the bottom for removing a slurry of solid particles in a liquid from the column, a gas inlet means connected to a lower portion of said column for introducing compressed gas into the column, a slurry inlet means located above the gas inlet means for introducing a slurry of solid particles in a liquid into the column, and an outlet means at the top of the column for removing a froth containing solid particles of interest;

a shaft extending centrally within the column from the top to near the bottom thereof;

means for rotating the shaft;

a plurality of impellers attached to the shaft and being spaced from one another, the impellers providing a gradient of turbulence to fluid within the column;

disks affixed to the shaft between adjacent impellers, the disks being oriented approximately normal to the shaft and each disk having the requisite diameter to provide the desired modulation of vertical swirling of fluid within the column; and a plurality of substantially centrally directed baffles positioned longitudinally and extending from the inner surface of the column.

2. A device as claimed in claim 1, wherein an impeller is provided on the bottom of the shaft to maintain a suspension of particles in liquid so that a slurry may exit the device through the outlet means at the bottom of the column.

3. A device as claimed in claim 1, wherein the gas inlet means is positioned just below the second impeller from the bottom of the shaft.

4. A device as claimed in claim 1, wherein the gas inlet means is a sparger.

5. A device as claimed in claim 1, wherein an upper portion of the column defines a froth zone having no impellers attached to the shaft.

6. A device as claimed in claim 5, wherein the slurry inlet means is located just below the froth zone.

7. A device as claimed in claim 5, further comprising a wash liquid inlet located within the froth zone.

8. A device as claimed in claim 7, wherein the wash liquid inlet is a sparger.

9. A device as claimed in claim 1, wherein said plurality of baffles comprise three baffles spaced about 120° from one another about the inner surface of the column.

10. A device as claimed in claim 1, wherein said plurality of baffles comprise four baffles spaced about 90° from one another about the inner surface of the column.

11. A device as claimed in claim 5, wherein the baffles extend from near the bottom of the froth zone to near the bottom of the shaft.

12. A device as claimed in claim 1, wherein each disk extends to or slightly beyond the reach of the blades of the impellers being adjacent thereto.

13. A device as claimed in claim 1, wherein the disks are solid and circular.

14. A device as claimed in claim 1, wherein the outlet means at the top of the column is a launder.

15. A device as claimed in claim 1, wherein the means for rotating the shaft is a motor.

* * * * *